United States Patent [19]

Wicker

[11] Patent Number: 5,018,767

[45] Date of Patent: May 28, 1991

[54] COUNTERFEIT PROTECTED DOCUMENT

[75] Inventor: Ralph C. Wicker, Rochester, N.Y.

[73] Assignee: Schmeiser, Morelle & Watts, Albany, N.Y.

[21] Appl. No.: 298,020

[22] Filed: Jan. 18, 1989

[51] Int. Cl.[5] ..... B42D 15/00

[52] U.S. Cl. ..... 283/67; 283/72; 283/85; 283/93; 283/94; 283/902; 356/374

[58] Field of Search ..... 283/85, 92, 93, 72, 283/902, 67, 94; 356/374

[56] References Cited

U.S. PATENT DOCUMENTS

| | | | |
|---|---|---|---|
| 27,857 | 4/1860 | Carey | 283/72 |
| 341,429 | 5/1886 | Phelps | 283/72 |
| 2,065,605 | 12/1936 | Moore | 283/93 |
| 2,952,080 | 9/1960 | Avakian et al. | 35/2 |
| 3,109,239 | 11/1963 | Wicker et al. | 33/1 |
| 3,675,948 | 7/1972 | Wicker | 283/6 |
| 3,862,501 | 1/1975 | Jemseby et al. | 283/93 |
| 4,033,059 | 7/1977 | Hutton et al. | 283/902 |
| 4,066,280 | 1/1978 | LaCapria | 283/92 X |
| 4,168,088 | 9/1979 | Somlyody | 283/93 |
| 4,506,914 | 3/1985 | Gobeli | 283/85 X |
| 4,525,858 | 6/1985 | Cline et al. | 356/374 |
| 4,579,370 | 4/1986 | Crowin et al. | 283/72 |
| 4,582,346 | 4/1986 | Caprio et al. | 283/93 X |
| 4,588,212 | 5/1986 | Castagnoli | 283/72 |

*Primary Examiner*—Paul A. Bell

*Attorney, Agent, or Firm*—Schmeiser, Morelle & Watts

[57] ABSTRACT

A method and product, resulting from application of the method, for making images on a document that will not be replicated properly by electro-optical scanning and copying devices. Documents that cannot be replicated by known copying machines or other replicating devices are produced according to the invention method, as well as alternative methods. All of the methods disclosed herein are instructive for making the images and art work on such documents by forming lines into various patterns in a manner imitative of intaglio or gravure printing. The pitch of the lineations is deliberately selected so as to vary minutely from the pitch of the scanning trace of various copying machines such as photocopiers, video opticons, and the like. The variation in pitch may be obtained by deliberately manufacturing the document with the desired pitch or, subsequent to the image placement therein, altering the dimensions or geometry of the document so as to effectively skew the pitch parameter.

13 Claims, 3 Drawing Sheets

COUNTERFEIT PROTECTED DOCUMENT

BACKGROUND OF THE INVENTION

1. Field of the Invention

This invention relates generally to bogus or counterfeit document detection methods and, particularly to the method for printing or otherwise making a product document that will be nonreplicable by any scanning-type copying device such as a copying machine, video opticon, and the like.

2. Discussion of the Prior Art

Many methods have been employed, as well as myriad machines, in order to verify the authenticity of documents such as bank notes, checks, licenses and identification pictures. Currency, security and other valuable documents are, in most cases, printed or lithographed onto high quality media such as silk, rice paper or high content rag paper. The printing may be black and white or color and most often employs one of two printing processes—line intaglio or gravure (rotogravure). The first, intaglio, is a process widely used in the production of bank notes, securities, stamps and engraved documents. The distinctive sharpness of fine lines and readily discernable differences in ink thickness that the process produces make it a preferred technique for production of bank notes and securities. The gravure pattern is similar to that of intaglio with the exception being that rather than fine channels appearing between lines, the gravure etching consists of extremely small square - like cells laid out in a grid array. In both of these methods of printing, the ink is held within the line troughs or square wells and transferred to the print media, under high mechanical pressures, by capillary movement. The gravure printing process is generally used for catalogs, magazines, newspaper supplements, cartoons, floor and wall coverings, textiles and plastics.

Other methods such as the Dultgen half tone intaglio process and the Henderson process (often referred to as direct transfer or inverse half tone gravure) are often used in place of the gravure but do not distinguish significantly over the previously described processes relative to the grid-like orientation of lines and dots (formed when the square-type wells are used). Since the purpose of the instant invention is to provide methods and a product made from such methods for preventing replication of any important document, in black and white or color, the remaining portion of this disclosure shall concentrate more heavily on intaglio printed surfaces rather than gravure or its variations. Further, most discussion will be confined to intaglio because a general disclosure relating to line printing would necessarily include dot printing as well since, by the inventor's definition, a dot is merely a line of short length, its length being equivalent to its width. Thus, the square-type well or dot of the gravure printing process may be likened to the intaglio wherein two sets of parallel lines or lineations, one orthognal to the other, are employed.

After an intense, exhaustive search of the literature and patents on file at the United States Patent and Trademark Office, the instant inventor turned from the more current methods and machines for document verification and devised the instant invention product and the methodology for its preparation. The philisophical motivation for the instant invention is twofold: first, in order to determine whether a document is counterfeit, it is not necessary to determine its authenticity—one only has to prove that a single element of the document is bogus; and second, a labored examination in order to determine a singular bogus element would be conducted best if the document were to contain within itself the means that would prevent its replication. In order to achieve these two objectives, it was necessary for the instant inventor to blend his skill in printing with the knowledge of optics that is readily available to one of ordinary skill. Accordingly, and being long familiar with the phenomenon of moire that often occurs in printing, he reasoned that what had always occured as a problem could be turned to the advantage of society in the elimination of the counterfeiting of face - value documents. For the edification of the reader it will suffice to say that the moire is a serious problem in color reproduction. It is the occurance of an interference pattern caused by the over printing of the screens in colorplates (similar effects can be observed by superimposing two pieces of a fine grid network such as window screening). Indeed, the technique of rotating half tone screens, when making the negatives for a printing plate, has been developed in order to avoid the moire interference. Often it appears as the geometrical design that results when a set of straight or curved lines is superposed onto another set. If a grating design, made of parallel black and white bars of equal width, is superposed on an identical grating, moire fringes will appear as the crossing angle is varied from about one second of arc to about 45 degrees. The pattern will consist of equispaced parallel fringes; but, if two gratings of slightly different spacing are superposed, fringes will appear (known as "beat" fringes) which shift positions much faster than does the displacment of one grating with respect to the other. Finally, it has been noted that a different kind of moire pattern results when two families of curves of different colors are superposed—fringes of a third color are produced. An application of the use of the moire phenomenon is disclosed in U.S. Pat. No. 3,109,239, issued to the instant inventor and titled SCREEN ANGLE INDICATOR. This disclosure reveals a method that is used to locate, view and visually align the angle of half tone screens without the aid of magnification. The screen half tone which is to be read is placed over a screened 360 degree or 90 degree protractor which contains five half tone screens of about 60% in value 2½ degrees to the right and 2½ degrees to the left at angles of 45 degrees, 60 degrees, 75 degrees, 90 degrees and 105 degrees. When the screen is turned within 5 degrees of a predetermined angle, a moire interference pattern begins to visually form and, as the screen comes closer, a much darker and larger moire pattern becomes visible. When the screen reaches the exact angle to be located, the moire pattern appears greatly englarged and, in fact, turns either black or white. Any misalignment appears as an enlarged moire or secondary pattern; thus the screen angle indicator creates magnified images by interference in order to identify and locate or position a half tone screen at a given angle. It became apparent to the instant inventor, therefore, that the moire pattern, rather than as an indicator which is gradually removed from an image, may also be used as an indicator of some perhaps latent defect in a document. More appropriately, there had to be some way in which a pattern could be included in an image by printing it in a selected pattern. Then, when the image was viewed through a superposed grid, such as previously discussed, a moire pattern would be observed according to the degree in which the patterns interferred with each other. Moreover, if one were to reduce the moire apparatus to its simplest form, that is, such as viewing some background through the common parallel-stake snow fence (suggested by the previous description of parallel black grid lines spaced by parallel white or clear areas of equal width), and if the pattern over which it is superposed is formed of lines and dots that are equally spaced from each other (whether parallel or curvilinear), but a fraction off the pitch (or spacing) of the overlain grid, the observer would be deprived of a high percentage of the background field of vision. Thus, the background image, if formed of the line and dot printed grid, would be rendered nonreplicable to any apparatus being used to record the view. It is this particular aspect of moire pattern creation that is used by the instant inventor to create this invention. Further, he also recognized that because the modern copy machine, whether it be a standard color tone copier or a laser printer, scanned the image to be copied with a fixed-pitch scanning system, it was unnecesary to devise overlay grid means. In fact, the modern replicator contains such a grid in the fixed - pitch, parallel scan format that is used to view the image to be replicated.

When apprised by friends, who dealt in the field of secure documents and negotiable instruments, that the advent of the color copier had almost overnight imbued the amateur counterfeiter with the ability to reproduce such documents as currency notes, travelers checks, and the like, it became readily apparent to the instant inventor that conventional means of document authentication would be insufficient to stop an almost exponential increase in the preparation of bogus documents. For example, with but minor skill and manipulation of controls, a modern color copier, especially of the laser type, can make a most credible reproduction of United States Bank Notes, travelers checks, drivers' licenses and identification cards. So good are the replicas, that department store clerks, grocery clerks, bank tellers, change machines, and a host of others have been duped by the introduction of these replicated documents into the market place. Major efforts of others attempting to solve this problem at costs totaling several million dollars have all been unsuccessful. In particular, no one heretofore has found a way to provide an original banknote or important document which embodies the two often-sought features of a copy-proof instrument; for example, one which to the unaided eye is both indistinguishable from a prior (genuine) item and which is capable only of obviously bogus copier replication.

SUMMARY OF THE INVENTION

The problem posed by copier replication has been solved by this invention, which is based upon the serendipitous discovery and novel concepts described below. Consequently, it is now possible, for the first time, to produce legal tender paper currency, genuine travelers cheques, original postage stamps, government issued food stamps, important documents or certificates and the like, which to the naked eye are indentical to prior items of the same kind but, in fact, have characteristics which reveal copier (especially color) replications to be obvious counterfeits.

The instant inventor in the course of searching for a solution to this problem accidentally discovered that a color copier replication of an original travelers cheque cannot itself be used to produce a closely matching copy. Actually, it was found, surprisingly, that no matter how the color copier was adjusted to eliminate blemishes or defects apparent to the casual observer, the copies made from the first copy always had such prominent tell-tales, in one form or another.

On the basis of his knowledge and skill as an expert in the printing art and the science of optics, the instant inventor recognized that in this discovery he had the key to solving the copier replicating problem. Thus, he conceived the idea of using the bane of the printer to the advantage of the counterfeit preventor. He would use the moire effect to reveal the bogus color copy of a genuine banknote, for example, by producing the banknote image lineations in mismatch to the scanner of a color copier. The mismatch would be slight and not noticeable to the naked eye and thereby both basic requirements, which no one else was ever able to meet, could be totally satisfied. Moreover, the cost of producing such counterfeit-proof certificates need not be substantial. The instant invention is therefore conceived to counteract a specific illegal threat, without having to resort to legislative acts which would in some way hinder the technological growth and refinement of the photocopy machine industry, and its most noteworthy products. It consists in a product, a face-valued document (generally, but not always printed) that cannot be replicated by any known color copying system. The instant inventive method succinctly instructs the reader in both ways of producing the product and in a correlative method for determining whether a suspected document is a counterfeit that has been made from a non-copy-protected, authentic document which does not contain the nonreplicability factor inculcated by the present disclosure. The basic method of counterfeit protection teaches the inclusion of lines, dots and/or swirls embodied and integrally formed into art, pictures and other forms of images. The grid lines are made so as to differentiate minutely in vertical and/or horizontal pitch from the linear grids employed by the scanning mechanisms of the machines used to replicate these black - white or colored documents. Generically, such scanning replicators are typically black and white optical reproduction systems, such as office copiers, color copiers, and opticons that are used in conjunction with video systems. Subclassed in this generic group are the new and increasingly common, laser color and black and white optical reproduction systems. After creation of the authentic document, that is, one including the grid lines of predetermined pitch, the primary method of counterfeit protection, as well as the product thereof, have been realized. Any attempt at imitation or replication by means of a scanning-type copier will result in the generation of inteference patterns and tones which are readily discernable (by the untrained and naked eye) from the original (or authentic) document in that the aesthetics of the document are distorted, omitted or otherwise completely destroyed in the replication. Generally, the dark tones of the authentic document will copy darker, while the blurred or light to medium tones will copy lighter, whiter or completely disappear. Any attempt by the counterfeiter to eliminate the patterns and distortions in the replicated copy, by color correction or by angular movements of the faulty replication, will result in intensifying the aforementioned lightening and darkening effects; and it will cause secondary patterns, latently embedded in the original, to appear visible, thus rendering the replication or counterfeit as an obvious bogus document.

A corollary to the primary method for making a non-replicable image is also inculcated by this disclosure. In cases where a counterfeit copy has been successfully made, say from an authentic document which has not been copy protected by the above mentioned method, and the method of replication has employed a scanning-type replicator or copy machine, the counterfeit document, no matter aesthetically pure it may appear to the naked eye, nonetheless contains included lines that already differentiate minutely in vertical and/or horizontal pitch from the authentic document's print format. In other words, the counterfeit copy now contains the seeds for its own detection if the instant inventor's correlative methodology is then applied. Such detection requires that the suspected counterfeit copy be first viewed and recorded by means of a scanning and imaging device such as a copy machine, a television opticon, or the like; and after such recording, comparing an authentic species of the original document with the recording of the suspected counterfeit and determining if the record of the suspected counterfeit reveals moire distortions relative to the authentic species. If so, the examining party will be able to confirm that the suspect document is indeed a counterfeit.

Regressing briefly to the "snow fence" effect (that was mentioned in the Description of the Prior Art), an alternative method of employing the moire effect is also herein disclosed. A moire-distorted pattern is replicated quite readily if document imaging is realized by using a rather high number of lineations relative to the replicator scan line frequency. The notion here is that the "snowfence" slats (i.e., the spaces between the replicator scan lines) obstruct more of the authentic image, thus distorting the replica. This is most noticable in color counterfeiting.

With the means taught herein, of producing a nonreplicable document of the instant invention, as well as means for detecting a bogus copy of an authentic document not so protected, financial entities and government instrumentalities are now relieved from the potential counterfeit onus that was inadvertently placed upon them by the advent of accurate and sophisticated replication systems.

From the foregoing, and in view of the detailed description set forth below, it will be understood that this invention has both method and article of manufacture or product aspects. Further, in its method aspect this invention comprises the step of producing an electro-optically nonreplicable original certificate by providing on a matte a lineate pattern of visible image-defining lines which are of predetermined moire-producing pitch relative to an electro-optic copy machine scan protocol. Otherwise expressed, this method includes the preliminary step of determining the pitch of an electro-optic copy machine scanner.

In its article of manufacture or product aspect this invention then, likewise briefly stated, is an electro-optically nonreplicable original certificate which bears an image defined by a plurality of lines of predetermined moire-producing pitch relative to the scan lines or pattern of an electro-optic copy machine.

Further defined in preferred embodiments this aspect of the invention takes the form of a multicolor certificate such as a travelers cheque, banknote, food stamp, postage stamp, or other government or private organization official issue.

As used herein and in the appended claims the terms "general" "original" "legitimate" "legal" "legal tender" "first run" and "authorized" mean and intend noncounterfeit issue. Also, the term "matte" designates or describes the paper cloth, parchment or other sheet material or tissue of which banknotes, travelers cheques, postage stamps, official documents and certificates and the like are made.

DETAILED DESCRIPTION OF THE PREFERRED EMBODIMENT

By use of FIGS. 1*a* through 2*c*, the reader shall now be instructed in the method of producing the nonreplicable image of the instant invention.

Figure 1A:
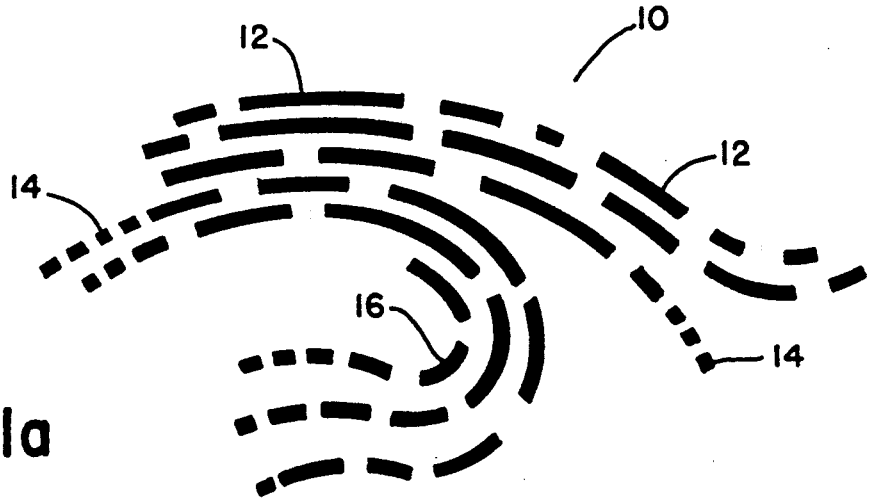
FIG. 1*a* is the pattern of lines, dots and swirls of an intaglio or gravure print.

Referring particularly to FIG. 1*a*, there is depicted therein a typically printed pattern 10 consisting of various lines 12, dots 14 and swirls 16. Those of ordinary skill will readily understand that such an image may be printed in intaglio or gravure (more commonly rotogravure) and adaptations of these processes. Further, any process of manufacture which represents visible images by periodically spaced lines, dots or swirls, whether or not printed, (say included by fibre or stain patterns) will produce a product giving satisfactory moire results. Methods of etching, photo engraving and plate manufacture are beyond the scope of the instant disclosure and shall no longer be referred to within this text.

Figure 1B:
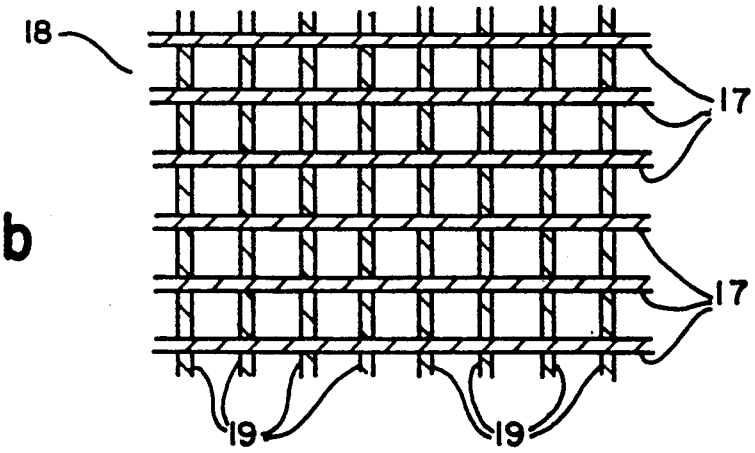
FIG. 1*b* is a grid overlay.
Figure 1C:
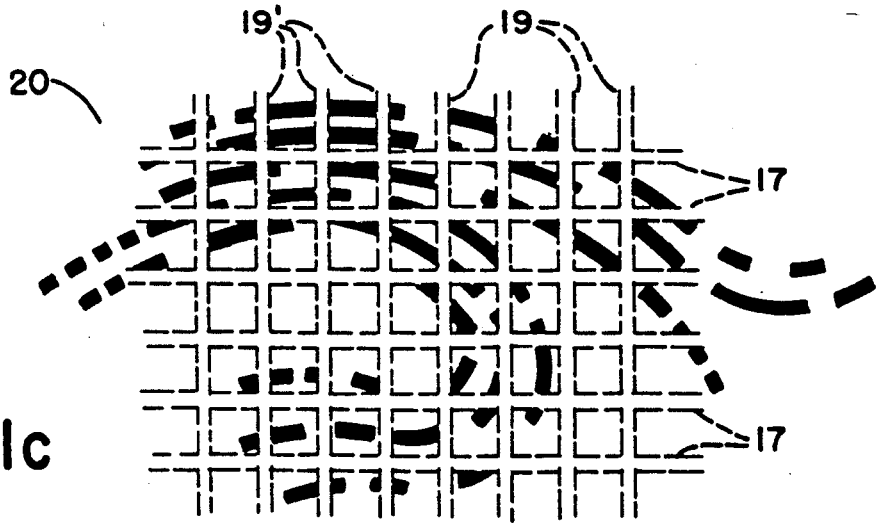
FIG. 1*c* is the view of FIG. 1*a* through the grid overlay of FIG. 1*b;*

A grid overlay is revealed in FIG. 1*b* consisting of an array of parallel, equally spaced black stripes oriented orthogonal to a similar pattern of black stripes 18. The grid of FIG. 1*b* is analogous to the earlier mentioned snow fence pattern through which one might view a background image. When the FIG. 1*b* pattern is overlain the FIG. 1*a* printed pattern, a distortion 20 in the FIG. 1*a* pattern results as shown in FIG. 1*c*. The instant inventor defines the FIG. 1*c* pattern as a type of moire distortion pattern resulting from a mapping of the FIG. 1*a* pattern by the function of the FIG. 1*b* grid overlay. Those of ordinary skill will also recognize that, were the function to be reversed, that is, if the grid lines 17', 19' of FIG. 1*b* were to become the areas of image transmittal (rather than obstruction), and the areas between the lines to be areas of obstruction or opacity, the FIG. 1*c* map would depict the compliment of the illustration 20 actually shown. It can also be readily seen that the entire grid of FIG. 1*b* is not required in order to obtain the desired results of FIG. 1*c*. The vertical portions 19 of the overlay grid are not required; indeed, the relative ease by which a horizontal grid overlay may be realized in the scanning-type replicating machine (or instrument) lends itself wonderfully to its use in this invention. The solution of the problem to the counterfeiting of printed documents lay in a form of reverse engineering wherein the recognition of a grid form of scanning in all replicating devices, and a knowledge of the moire effect, led the instant inventor to reason that a distorted image would result any time a grid-like scanning pattern failed to map any discrete part of an authentic document into its replica. If, for example, the horizontal lines 17 of FIG. 1*b* were the nonscanned areas in a copy machine scanning protocol, and the interstitial or "see through" areas corresponded to the actual scanning lines, the illustration of FIG. 1*c* would in reality be the resultant replica or counterfeit. It can be readily seen that, to the naked eye, there might be very little distinction between the authentic and the counterfeit documents; however, if the FIG. 1*a* print were arranged cleverly so as to ensure that the greater part of the image was not picked up by the scanning protocol, the resulting copy would be highly distorted, full of moire interference patterns and significant omissions. By this reasoning, the instant inventor devised the invention which is now succintly described with the aid of FIGS. 2*a* through 2*c*.

Figure 2A:
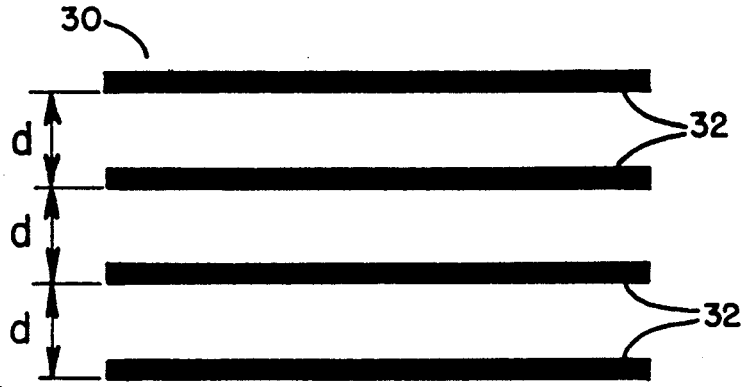
FIG. 2*a* is an intaglio print of horizontal, equidistantly spaced lines.
Figure 2B:
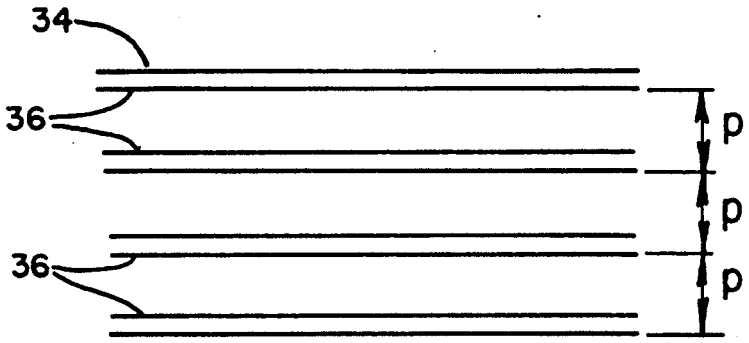
FIG. 2*b* is the scanning pattern of a replicating machine.

For the purposes of clarity, the pitch between printing lines and dots or between scanning lines of a replicating device shall be termed d in the case of the printing, and p in the case of the scanner. Turning now to FIG. 2*a*, there is depicted a typical intaglio printing 30, much like the printing of FIG. 1*a*, but less stylized. The lines 32 are separated by the pitch distance d; thus, they are parallel and equispaced. FIG. 2*b* represents the scanning pattern 34 of any specifically identified replicating device such as a color copying machine, laser scanner or television opticon. Scanning on a very carefully controlled frequency, the scan lines 36 are parallel and have a constant pitch p. The very nexus of this invention demands that d be minutely more or less than p, say from half the scan line width up to 50% of p. With an appropriate choice of d incorporated into the printed image as exemplified in FIG. 2*a*, the scanning of FIG. 2*b* maps the printing into the replicated copy 38, shown in FIG. 2*c*. At an arbitrary point where a scan line 36 is superposed directly on a print line 32, the replication 37 will be exact. However, thereafter and if the print pitch d is properly selected, there will be a greatly diminished frequency of overlap and the authentic pattern, to a great extent, will be lost. This is shown clearly in FIG. 2*c* by the coincidence of print lines 32' and scanning lines 36'.

Figure 2C:
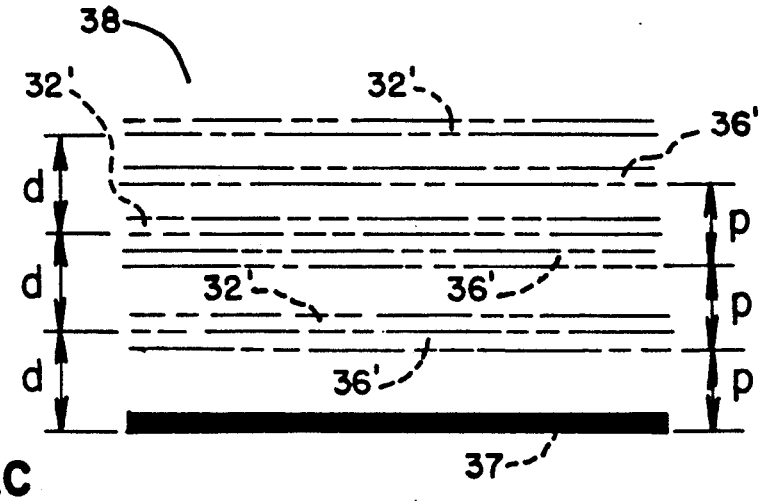
FIG. 2*c* is a mapping of FIG. 2*a* produced by the scan lines of FIG. 2*b;*

It becomes apparent to the reader what the writer meant by the above statement "d be minutely more or less than p", for the mapping essence of FIG. 2*c* would be realized if d were less than p, instead of the indicated relationship shown in FIGS. 2*a* and 2*b*. The only difference would be the location of replica line 37, relative to the various print lines 32' and scanner traces 36'. Replica line 37 would appear because, as shown in FIGS. 2*a*–2*c*, scanner traces 36 would "see" only a smaller set (here for illustration, only one) of print lines 32, thus transferring it only to the replica.

Figure 3A:
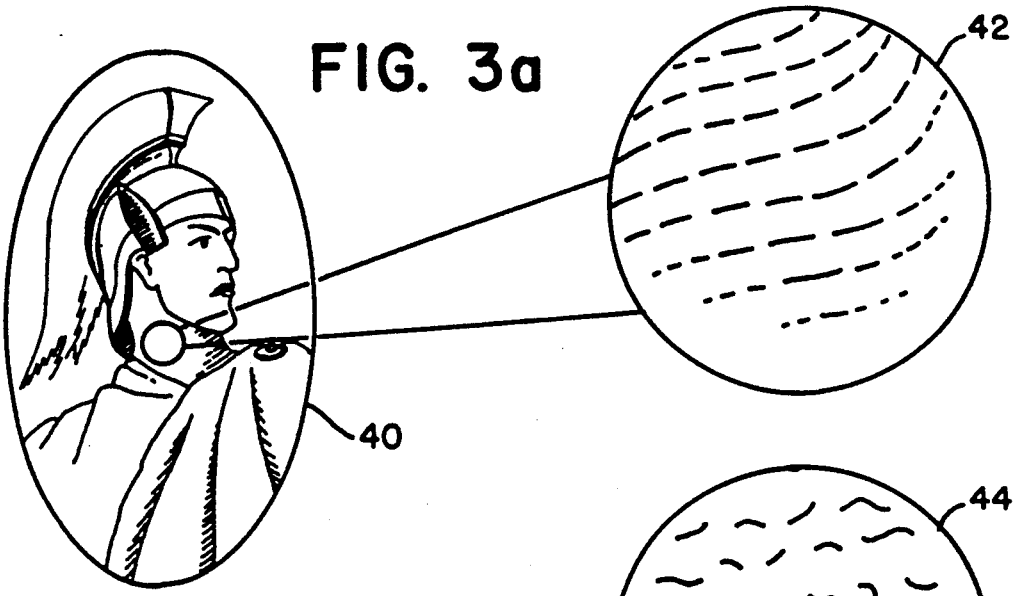
FIG. 3*a* is an illustration of the print pattern of a familiar printed image.
Figure 3B:
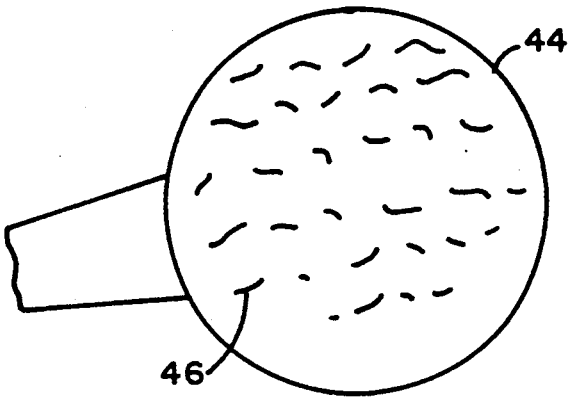
FIG. 3*b* is the moire skewing of the FIG. 3*a* print pattern.
Figure 3C:
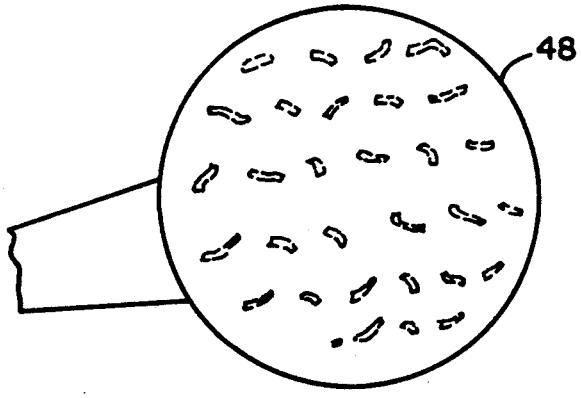
FIG. 3*c* is a blurring or defocusing of the FIG. 3*b* pattern in anticipation of reconstruction.
Figure 3D:
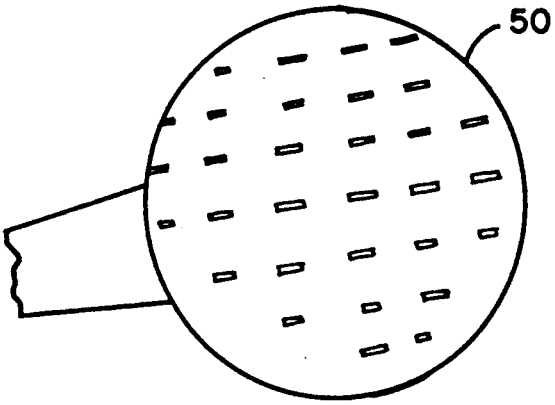
FIG. 3*d* is the screened image of FIG. 3*c* in preparation for reprinting.

One of the most noteworthy attributes of the instant invention is the inherent ability of the method and product to defy reconstruction of the authentic pattern. For example, those skilled in forms of decryption, that is reconstructing an authentic image by purposefully defocusing the lines and dots which form the composite image and then rescreening in preparation of a reetching would be frustrated in an attempt to retrieve an authentic document from the invention-skewed bogus copy. Referring to FIG. 3*a*, there is shown an illustration 40 that appears on a familiar negotiable instrument that is not protected according to this invention. The detail 42 in FIG. 3*a* is the representation of the print pattern in one small portion of the document. Immediately below this, at FIG. 3*b* is the illustration 44 of what would be seen in the same detail of a counterfeit protected document having a pattern typical of the instant invention used in its production. It may be readily discerned that the replicated pattern 46 bears strong resemblance to that shown in FIG. 3*a*. In an attempt to reproduce the pattern of 3*a*, the pattern in 3*b* is deliberately defocused or blurred 48 as depicted in FIG. 3*c*. After this blurring process, a counterfeiter would rescreen the image to prepare a new etched plate in order to reproduce an authentic looking document. FIG. 3*c* illustrates the FIG. 3*b* pattern as it would appear blurred. However, were the counterfeiter now to screen the FIG. 3*c* blurred pattern, the result would be the pattern 50 of FIG. 3*d*. A cursory comparison of the FIG. 3*d* pattern 50 to the detail 42 of FIG. 3*a* evidences the futility of such a technique, if applied to a document prepared according to the teachings of the instant invention. Generally speaking, the FIG. 3*b* rendering of the FIG. 3*a* authentic document contains imaged areas that are anywhere from 35% to 50% reductions of the pristine image. Further, an attempt to replicate, on the offset press, the attempted reconstruction at FIG. 3*d* will result in an image containing an additional 50 to 75% degradation in detail and hue.

To this point, the instant inventor has taught the invention in terms of varying the pitch distance between image lines so as to "detune" them or create a dissonance between the print pattern in the document and the known frequency or pitch pattern of a scanning device. That is not to say however that an exacting print of such nature must always be had in order to embody the teachings of the inventor. A highly practical method is devised whereby the pitch in the printed document may be arbitrarily varied, thereby acquiring the benefits of the instant invention. This method is to simply change the dimension of lines and dots on a document so as to inherently vary the pitch between the various pattern elements. Accordingly, the instant inventor suggests that, after a document of the type contemplated herein has been printed, the medium upon which it is printed be dimensionally altered, generally by the application of heat. If performed on a suitable printing matte, the imprinted pattern will be subtly altered and the basic concept of the invention incorporated therein. It is recommended that a high quality, high rag content paper or a high quality rice paper such as is used in the printing of currency, be utilized.

The benefits of the aforementioned technique can be casually acquired by documents that are subjected to handling and indeed, those which have been counterfeited, especially since the toner application process of a color replicating device employs a matte-warping (distorting) heat process of the type described above. A replication of such a distorted document, by either a color o black and white copier, or a scanning video opticon, will produce an image that is literally full of moire distortions. Thus, it follows that if one attempts to copy or video scan a photocopy counterfeit of an authentic document (color or black and white), the result is a severe moire - distorted image, because the heat of the counterfeiter's copier has distorted the copy matte, and thus the pitch of the authentic document's image lines, as taught by this disclosure.

Another methodological corallary may be employed in cases where the scanning machine-replicator utilizes a scan line of greater than customary width. In such a situation, use of a document imaging process similar to that disclosed herein, but employing a much smaller lineation pitch (with a concomitant greater number of lineations) is most efficacious. If the lineations exceed 250 to the inch, the moire effect in the replica will be noticeable to the unaided eye, even with standard and unsophisticated copiers/replicators. This lineation frequency (250 lines/inch) is significantly higher than that used in the industry, today.

Myriad applications of the teachings in this disclosure are available to and may be made by those of ordinary skill and are limited only by the claims hereinafter appended.

What is claimed is:

1. Replicating, by printing, a first photocopier counterfeit of a face-value document, said printing containing substantially all counterfeit-mapped characteristics relating to images thereof that comprise, upon further photocopying, moire-and omission-producing lineation factors including size, shape and spacing, or tuning, of image-forming lines.

2. A method for making an image, of which the replication thereof by electro-optical means having a known scanning pitch is distorted in color or pattern, comprising the steps of:

selecting a suitable matte for creation of said image thereon; and placing visible and distinct lineations dissonant from the scanning pitch into various patterns of curvilinear lines, dots or swirls on said matte, said lineations having a predetermined distance therebetween which is termed lineation pitch and which is deliberately chosen to be out of registry with the known pitch, whereby when said image is scanned by an electro-optical scanning device and copied by this device, a moire-skewed copy of the image results because of the nonregistration between the pitches in said image and the device.

3. The method of claim 2 wherein placing comprises printing.

4. The method of producing an original certificate which resists counterfeiting by an electro-optical copying device and comprises placing on a substrate a visible pattern of various length curvilinear markings, said visible pattern being of omission-and moire-producing composition relative to the electro-optic copying device, the effects of said pattern which cannot be avoided by adjustment of the device or orientation of said original certificate on the device.

5. A method for making a replicant document replicable by photocopier and other electro-optical scanning type copying machines inaccuratly and as bogus relative to a replicate's content, color and tone, said method comprising:

obtaining a true and original face-value document that is not protected by a moire-and ommission-producing line creation technique; and replicating said document by conventional mapping technique on a photocopying machine, whereby said replicating produces a resultant replicate document which is made of image lineations that are dissonant from and relative to the image lineation pitch and image lineation shapes of the true document, whereby said replicate is a true document of nonreplicable form because any further attempts to subsequently copy said replicate document by photocopying machine or other electro-optical scanning devices will produce a copy that is visibly untrue having therein omissions, distortions and moire skewing of the image of said replicate document.

6. A method for making a copy/counterfeit protected document comprising the steps of:

determining the pitch frequency of a known copying machine, by which counterfeit copies of documents are readily attainable, for the purposes of ascertaining a lineation pitch frequency which, when placed as a series of lineations on a document, is out of synchronization with an electro-optical device within the machine having a protocol for scanning a document to be copied, whereby when an out-of-registry event occurs as the document is copied by a copying machine, such an out-of-registry event will repeat with calculable certainty in other line scans during the scanning protocol; and deliberately placing picture, portrait and design image lineations on a document matte at or near the lineation pitch frequency ascertained in the first step and subtly bending the lineations, during said placing on said matte, to effect azimuthal lineation changes, whereby an attempted copying of said documents bearing said first step-determined lineation pitch and azimuthal parameters, if successful because of registration of said lineations with copy machine protocol, is inaccurate because of inherent inability of an electro-optical scanning device to accurately and precisely detect parts of the lineations of images that fall within the spaces between its scan lines.

7. The method of claim 6 wherein said determining step further comprises choosing a lineation pitch frequency for said placing that is a factor of the frequency of said determining step and will also affect said registration or misregistration.

8. A method for making counterfeit-proof images in documents, so that the replication thereof by an electro-optical copier means having a known scanning protocol is distorted in color or pattern, comprising the steps of:

selecting an electro-optically replicable document of a type which is to be afforded said counterfeit-proof images and copying it precisely by the electro-optical copier means in order to obtain a replicant first copy thereof; and placing images on a desired number of suitable mattes by mapping thereinto picture, portrait or value indicia compositions as similar compositions appear on the first copy, thus rendering said images of said placing counterfeit-proof, because the first copy bears imaging comprised of discretely pitched, curvilinear markings of lines, dots and swirls when composed by the electro-optical copier means and deliberate emulations thereof, namely said mattes, possess identical non-replicability factors as possessed by the first copy.

9. The method of claim 8 wherein said placing comprises printing.

10. A method for making a printed document that is non-counterfeitable by photocopier machines comprising first copying an unprotected and counterfeitable document on a photocopier machine to obtain a counterfeit document which is itself not replicable; and then printing said printed document with desired images of pictures, portraits, designs or value indicia by mapping such as printing, line, dot and swirl patterns, imitative of the counterfeit document onto a matte, whereby said printed document, like the counterfeit document produced by the machine, will no longer be counterfeitable by the machine and others of its type.

11. The method of making an original certificate that is capable only of electro-optically inaccurate replication, said method comprising the step of placing on a substrate a lineate pattern of visible image-defining lines, said lineate pattern being of predetermined omission-creating, moire-producing pitch in mismatch to the scanning pitch and pitch azimuth of an electro-optic copy device, characterizing a device mapping-printing of said lineate pattern in dots, lines and swirls that closely approximate dot, line and swirl patterns of a photocopy machine replication of a non-copy protected document that is similar to said original certificate.

12. A method for making a replicant document that will only be subsequently replicated inaccurately and obviously bogus relative to the image content, color and tone of said replicant document by devices with grid-like scanning pattern, such as by photocopier or other electro-optical scanning devices, said method comprising:

obtaining a true and original face-value document that is not protected against photocopier counterfeiting by moire-producing techniques and lineation pitch-scan pitch dissonance techniques;

mapping by photocopying said original face-valued document to a suitable matte in order to determine by the mapping what types of lineations cannot be recorded and copied by the devices, because they are incapable of replicating a photocopy; and, printing said replicant documents while altering, like the photocopy, certain lineation characteristics of the original face-value document including dots, curvilinear lines and swirls of pictures, portraits, designs or value indicia, such as were mapped to the photocopy, thereby ensuring that the devices will not further map said certain lineation characteristics to other mattes.

13. The method of making an electro-optically nonreplicable image on a matte which comprises the steps of:

selecting a document bearing an image which is to be rendered nonreplicable;

electro-optically producing a copy of the image through scanning means;

selecting a suitable matte; and mapping onto said matte by suitable means, such as printing, visible lineations such as curvilinear lines, dots and swirls of said image at a predetermined pitch and azimuth defined by the copy, which is itself non replicable, whereby said matte bears images rendered nonreplicable to whatever type scanning means produced the copy.

* * * * *

UNITED STATES PATENT AND TRADEMARK OFFICE

CERTIFICATE OF CORRECTION

PATENT NO. : 5,018,767

DATED : May 28, 1991

INVENTOR(S) : Ralph C. Wicker

It is certified that error appears in the above-identified patent and that said Letters Patent is hereby corrected as shown below:

On the Title page:

Delete Assignee data at [73]. Enter at [73] the following :

-- Assignee: Schmeiser, Morelle & Watts; Albany, N.Y., a part interest.--

Signed and Sealed this

Twelfth Day of January, 1993

*Attest:*

DOUGLAS B. COMER

*Attesting Officer*

*Acting Commissioner of Patents and Trademarks*